US006892033B2

(12) United States Patent
Sunada et al.

(10) Patent No.: US 6,892,033 B2
(45) Date of Patent: May 10, 2005

(54) IMAGE FORMING APPARATUS HAVING APPARATUS MAIN ASSEMBLY AND A PROCESS CARTRIDGE INCLUDING NON-CONTACT MEMORY PERFORMING NON-CONTACT DATA COMMUNICATION WITH THE APPARATUS MAIN ASSEMBLY

(75) Inventors: Hidenori Sunada, Toride (JP); Eiichi Motoyama, Tokyo (JP); Yoshihito Osari, Tokyo (JP); Satoru Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/689,653

(22) Filed: Oct. 22, 2003

(65) Prior Publication Data

US 2004/0136751 A1 Jul. 15, 2004

Related U.S. Application Data

(63) Continuation of application No. PCT/JP03/12410, filed on Sep. 29, 2003.

(30) Foreign Application Priority Data

Sep. 30, 2002 (JP) ..... 2002-285221

(51) Int. Cl.[7] ..... G03G 15/00; G03G 21/18
(52) U.S. Cl. ..... 399/13; 399/111; 399/167
(58) Field of Search ..... 399/12, 13, 25–27, 399/111, 167

(56) References Cited

U.S. PATENT DOCUMENTS

| | | | | |
|---|---|---|---|---|
| 5,909,603 | A | 6/1999 | Suzuki et al. | 399/13 |
| 6,332,062 | B1 | 12/2001 | Phillips et al. | 399/12 |
| 6,347,198 | B1 | 2/2002 | Yamamoto et al. | 399/27 |
| 6,351,621 | B1 * | 2/2002 | Richards et al. | 399/111 |
| 6,404,995 | B1 * | 6/2002 | Kimizuka | 399/13 |
| 6,546,212 | B1 | 4/2003 | Ogata et al. | 399/24 |
| 6,584,291 | B1 | 6/2003 | Yamamoto | 399/27 |
| 6,587,649 | B1 | 7/2003 | Yamamoto et al. | 399/27 |
| 6,594,451 | B1 | 7/2003 | Kakeshita et al. | 399/24 |
| 6,694,106 | B1 * | 2/2004 | Yoshimura | 399/12 |
| 6,701,107 | B1 * | 3/2004 | Karakama et al. | 399/111 |
| 2003/0035656 | A1 | 2/2003 | Yamamoto et al. | 399/27 |
| 2003/0053809 | A1 | 3/2003 | Ogata et al. | 399/12 |

FOREIGN PATENT DOCUMENTS

| | | |
|---|---|---|
| EP | 0 833 226 | 4/1998 |
| EP | 0 833 228 | 4/1998 |
| JP | 2000-100126 | 4/2000 |
| JP | 2002-149039 | 5/2002 |

OTHER PUBLICATIONS

Patent Abstracts of Japan, vol. 2000, No. 7, Sep. 29, 2000 (JP 2000–100126).
Patent Abstracts of Japan, vol. 2002, No. 9, Sep. 4, 2002 (JP 2002–149039).

* cited by examiner

*Primary Examiner*—William J. Royer
(74) *Attorney, Agent, or Firm*—Fitzpatrick, Cella, Harper & Scinto

(57) ABSTRACT

An image forming apparatus includes an apparatus main assembly, and a process cartridge detachably mountable to the apparatus main assembly, including a driving force receiver to be connected to a driver of the apparatus main assembly and a non-contact memory for carrying out non-contact data communication with a receiver of the apparatus main assembly, wherein the apparatus main assembly performs rotational driving of the driver before reading out data from the non-contact memory.

5 Claims, 5 Drawing Sheets

IMAGE FORMING APPARATUS HAVING APPARATUS MAIN ASSEMBLY AND A PROCESS CARTRIDGE INCLUDING NON-CONTACT MEMORY PERFORMING NON-CONTACT DATA COMMUNICATION WITH THE APPARATUS MAIN ASSEMBLY

CROSS REFERENCE TO RELATED APPLICATIONS

This application is a continuation of PCT Application No. PCT/JP03/12410 filed Sep. 29, 2003.

BACKGROUND OF THE INVENTION

1. Field of the Invention

The present invention relates to an image forming apparatus including a process cartridge which is detachably mountable to a main assembly of the image forming apparatus, particularly an image forming apparatus which permits data communication between a non-contact memory mounted process cartridge and the apparatus main assembly.

2. Background Art

For example, in an ordinary image forming apparatus, such as a copying machine, a printer or the like, a load unit constituting a part of an image forming means, such as a photosensitive drum or an intermediary transfer belt, is rotationally driven by transmitting thereto a driving force (power) through a coupling or connection mechanism disposed between such a load unit and a driving source of the main assembly of the image forming apparatus. Such a load unit reaches the end of its life due to wear and/or deterioration with time. The life of the load unit is shorter than that of the image forming apparatus main assembly, so that there is a need for the load unit to be replaced with a new one on several occasions until the image forming apparatus main assembly reaches the end of its life. For this reason, the load unit is used in the form of a cartridge in view of the ease in mounting and dismounting the cartridge in many cases.

In recent years, a memory has been provided in the cartridge so as to have the following functions (1), (2) and (3):

(1) in the memory, data, such as initial characteristics of the unit at the time of the production thereof, identifying (discriminating) information thereof, or the like is stored, and the data is used for switching control specifications for the photosensitive drum, or the like in the cartridge;

(2) in the memory, data on an operation time of the unit is stored and used for judging the unit's replacement timing; and (3) in the memory, the same fluctuation values vary, depending on durability factors of the unit, and optimum image formation is performed on the basis of the most up-to-date values.

As a result, the memory is utilized for improving image qualities of the image forming apparatus.

As the memory for such a purpose, a non-contact memory is used in many cases, since it has the advantages of, e.g., high reliability of point of contact attributable to high resistance to mounting/dismounting operations and a simple circuit structure. This is because, the non-contact memory carries out communication with the apparatus main assembly by transmission and reception of electromagnetic waves between antennas provided in both the apparatus main assembly and the memory, so that the non-contact memory does not need any contact between metal terminals as in a conventional memory, thus causing no problems arising from the required contact of terminals, such as noise, toner contamination, various vibrations, or the like.

With respect to the access procedure of the image forming apparatus to the non-contact memory provided in the memory as described above, Japanese Laid-Open Patent Application (JP-A) 2002-149039 has proposed that a state of means for transmitting electromagnetic waves to the non-contact memory is switched on the basis of a detection result determining whether a door is opened or closed, the door permitting a detachably mountable load unit to be mounted to and dismounted from an apparatus main assembly. In other words, when the door is opened, communication is stopped since there is a possibility that the load unit is removed, and on the other hand, when the door is closed, the communication is started since there is a possibility that the load unit is mounted.

However, in the case where the load unit is mounted at the time when the door is closed, the state in which communication is permitted with reliability is not necessarily optimal. When a user mounts the load unit into the apparatus main assembly by opening the door, it is by no means easy to mount the load unit at a predetermined position accurately at the time of image formation. This is because a drive portion of the load unit to be connected to the apparatus main assembly is required to be positioned with a high degree of accuracy. In other words, the allowance for positional deviation from the optimal position is very small.

On the other hand, a structure has been employed in which the apparatus main assembly is automatically moved to a predetermined position at the time of image formation by transmitting a driving force to the load unit in an image-forming operation so as to obviate the necessity for the user to take the trouble to accurately mount the load unit. Accordingly, somewhat of a positional deviation of the load unit with respect to the apparatus main assembly occurs immediately after the door is closed. As a result, an antenna on the load-unit side is not necessarily located in an ideal position.

To accommodate such positional deviation, the receiving sensitivity or the sending power of the antenna is increased in order to permit reliable communication before carrying out necessary operations for image formation. However, in this case, size reduction of the load unit becomes difficult, and there arises a possibility that an increase in sending powder causes interference with an antenna with which it is not intended to communicate or leakage of electromagnetic waves to the outside of the image forming apparatus in some cases. For this reason, in view of measures that can be taken against these problems, it cannot be said that communication is ensured even when the position of the load unit is somewhat deviated from the predetermined position.

SUMMARY OF THE INVENTION

An object of the present invention is to provide an image forming apparatus capable of providing a high stability in communication between a non-contact memory of a process cartridge and an apparatus main assembly.

According to the present invention, there is provided an image forming apparatus, comprising:

an apparatus main assembly, and a process cartridge detachably mountable to the apparatus main assembly, including driving force receiving means to be connected to driving means of the apparatus main assembly and a non-contact memory for non-contact data communication with receiving means of the apparatus main assembly, wherein the apparatus main assembly performs rotational driving of the driving means before reading out data from the non-contact memory.

This and other objects, features and advantages of the present invention will become more apparent upon a consideration of the following description of the preferred embodiments of the present invention taken in conjunction with the accompanying drawings.

DESCRIPTION OF PREFERRED EMBODIMENTS

Figure 1:
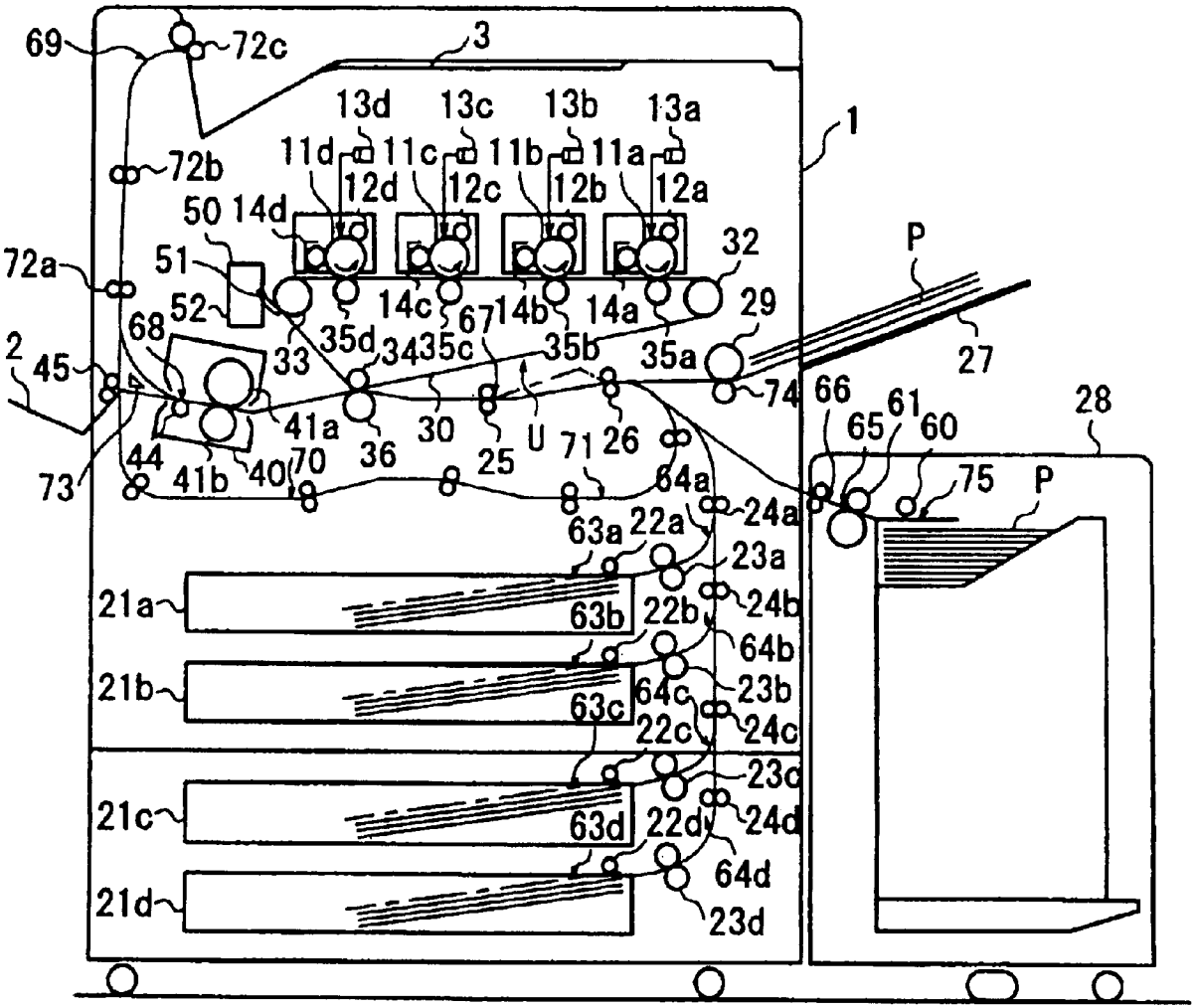
FIG. 1 is a schematic cross-sectional view of a general structure of the image forming apparatus of the present invention.

Hereinbelow, embodiments of the image forming apparatus according to the present invention will be described with reference to the drawings. In the drawings, identical reference numerals or symbols represent identical members or functions, and repeated explanations therefor are omitted as desired.

Embodiment 1

FIG. 1 is a cross-sectional view showing a four-color-based full-color printer as an embodiment of the image forming apparatus of the present invention.

Referring to FIG. 1, a printer (hereinafter, referred to as the "image apparatus") includes an image forming apparatus main assembly 1 which roughly includes four image-forming stations disposed in parallel with each other, a paper supply means, an intermediary transfer means, a conveyance means, a fixing unit, an operation means, and control means (not shown). The respective image-forming stations have the same structure.

More specifically, the image-forming stations include drum-type electrophotographic photosensitive members (hereinafter, referred to as the "photosensitive drum(s)") 11*a,* 11*b,* 11*c* and 11*d,* functioning as image bearing members. Each of the photosensitive drums 11*a* to 11*d* is supported by a central axis (shaft) and rotationally driven in a direction of an arrow shown in FIG. 1 inside the drums by a stepping motor and for each of the photosensitive drums 11*a* to 11*d* couplings for transmitting a rotational force are used.

Figure 2:
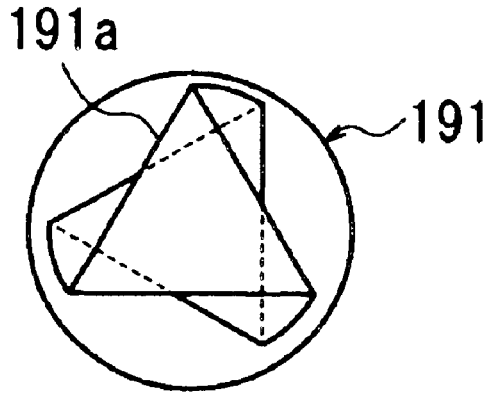
FIGS. 2 and 3 are a front view and a perspective view, respectively, of a coupling on a process-cartridge side of the apparatus.
Figure 3:
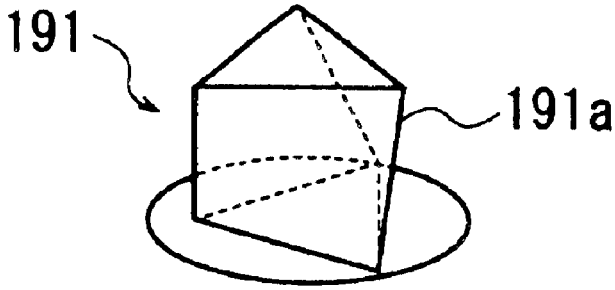
Figure 4:
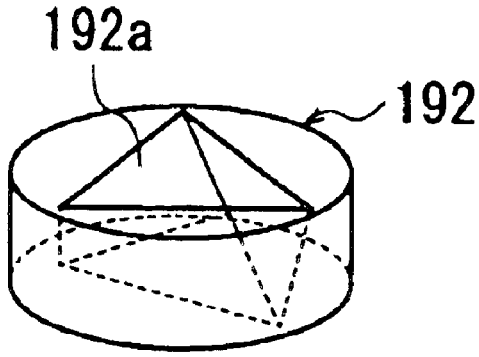
FIG. 4 is a perspective view of a coupling on a stepping-motor side of the apparatus.
Figure 5:
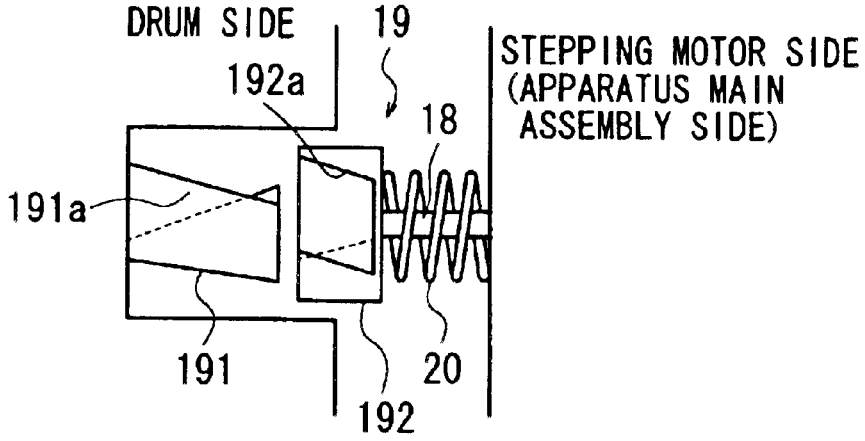
FIG. 5 is a schematic sectional view showing the coupling on the process cartridge and the coupling on the stepping motor opposite to and to be connected with each other.

The structure of the couplings will be described with reference to FIGS. 2–5, wherein FIG. 2 is a front view of the coupling on the photosensitive-drum side, FIG. 3 is a corresponding perspective view, FIG. 4 is a perspective view of the coupling on the stepping-motor side, and FIG. 5 is a view showing a state in which the couplings on the photosensitive-drum side and the stepping-motor side are disposed opposite to and to be connected with each other.

A coupling 19 (19*a,* 19*b,* 19*c* and 19*d*) is constituted by engaging a coupling 191 on the photosensitive-drum side and a coupling 192 on the stepping-motor side.

The coupling 191 on the photosensitive-drum side is formed in such a shape that a triangular pole 191*a* is twisted as shown in FIGS. 2 and 3, and on the other hand, the coupling 192 on the stepping-motor side is provided with a triangular hole 192*a* for engaging the twisted triangular pole 191*a* therein. These couplings 191 and 192 are used in combination, as shown in FIG. 5, so that the twisted triangular pole 191*a* of the coupling 191 on the photosensitive-drum side is disposed opposite to the triangular hole 192*a* of the coupling 192 on the stepping-motor side to engage the triangular pole 191*a* with the triangular hole 192*a* to connect both couplings 191 and 192 to each other. As a result, a driving force of the stepping motor can be transmitted to the photosensitive drums (11*a,* 11*b,* 11*c* and 11*d*) through the coupling 19.

Incidentally, in the case where the position of the triangular hole 192*a* of the coupling 192 is not in alignment with the position of the triangular pole 191*a* of the coupling 191 when the photosensitive drums 11*a* to 11*d* are set, the photosensitive drums 11*a* to 11*d* are accommodated in the image forming apparatus main assembly 1 by compression of a spring 20 shown in FIG. 5. Thereafter, the triangular hole 192*a* of the coupling 192 on the stepping-motor side is rotated when the stepping motor is rotated, whereby the triangular pole 191*a* of the coupling 191 on the photosensitive-drum side is engaged in the triangular hole 192*a* of the coupling 192 on the stepping-motor side (at this time the spring 20 expands) at a timing of positional alignment of the triangular hole 192*a* with the triangular pole 191*a* of the coupling 191 on the photosensitive-drum side. As a result, the driving force of the stepping motor is transmitted to the photosensitive drums 11*a* to 11*d.*

The size of the triangular hole 192*a* of the coupling 192 on the stepping-motor side is designed to be somewhat larger than that of the triangular pole 191*a* of the coupling 191 on the photosensitive-drum side, and the triangular pole 191*a* and the triangular hole 192*a* are twisted. As a result, when the coupling 191 shown in FIG. 2 is rotated clockwise, a force acts in such a direction that the engaging triangular pole 191*a* is pulled into the triangular hole 192*a,* whereby a connection or coupling portion between the stepping motor and the photosensitive drums (11*a* to 11*d*) is locked.

On the other hand, when the coupling 191 is rotated counterclockwise, a force acts in such a direction that the triangular pole 191*a* is pushed out of the triangular hole 192*a,* so that the connection (coupling) between the stepping motor and the photosensitive drum is released. However, when the coupling 191 is rotated slightly counterclockwise in the connection state, it is possible to cause the photosensitive drums 11*a* to 11*d* to remain stationary, although the locked connection is released by the clearance created due to a difference in size between the triangular pole 191*a* and the triangular hole 192*a.*

Based on such a structure of the coupling 19 (191, 192), the coupling 191 has such a property that it is locked to retain the connection state when the photosensitive drums 11*a*-11*d* are rotationally driven in the direction of the arrows inside drums 11*a* to 11*d* shown in FIG. 1 (in the ordinary rotational direction) at the time of image formation by normal rotation of the stepping motor. On the other hand, the coupling 191 also has such a property that the lock is released to release the connection state when the stepping motor is (reversely) rotated in the direction opposite from the direction of the arrows inside drums 11*a* to 11*d* shown in FIG. 1.

Incidentally, around the photosensitive drums 11*a* to 11*d*, along in their rotational directions, charge rollers (charging means) 12*a*, 12*b*, 12*c* and 12*d*; scanners (exposure means) 13*a*, 13*b*, 13*c* and 13*d*; and developing apparatuses (developing means) 14*a*, 14*b*, 14*c* and 14*d* are disposed substantially in this order.

The charge rollers 12*a* to 12*d* impart electrical charges with a uniform amount of charge to the surfaces of the photosensitive drums 11*a* to 11*d*, respectively, to uniformly electrically charge the photosensitive drums 11*a* to 11*d*, respectively, to a predetermined polarity and a predetermined potential.

The photosensitive drums 11*a* to 11*d* after the charging process are irradiated with a light beam, such as a laser beam, which has been modulated depending on picture (image) information. As a result, on the photosensitive drums 11*a* to 11*d*, electrical charges at their irradiation portion are removed to form electrostatic images.

The electrostatic images are visualized (developed) as (color) toner images by the developing apparatuses 14*a*, 14*b*, 14*c* and 14*d* containing therein developers (toners) of yellow, cyan, magenta and black, respectively. The developed toner images are successively transferred onto an intermediary transfer belt 30.

Through the above-mentioned processes, image-forming operations with the respective color toners are successively performed. At the time of image formation, various values as to the image-forming operations are stored in a memory (not shown).

The paper-supply means includes a portion for accommodating a recording material P (e.g., paper or a transparent film), a roller for conveying the recording material P, a sensor for detecting passing of the recording material P, a sensor for detecting the presence/absence of the recording material P, and a guide (not shown) for conveying the recording material P along a conveyance passage.

In FIG. 1, the apparatus main assembly 1 includes paper-feed cassettes 21*a*, 21*b*, 21*c* and 21*d*; a manual-feed tray 27; and a paper-feed deck 28. In these members, the recording material P is held. The apparatus main assembly 1 further includes pickup rollers 22*a*, 22*b*, 22*c* and 22*d* for feeding the recording material P one by one from the paper-feed cassettes 21*a* to 21*d*, respectively. These pickup rollers 22*a* to 22*d* feed a plurality of sheets of the recording material P in some cases, but only one sheet is separated with reliability from the fed sheets of the transfer material by BC rollers 23*a*, 23*b*, 23*c* and 23*d*, respectively.

The thus-separated sheet is conveyed to registration rollers 25 through drawing rollers 24*a*, 24*b*, 24*c* and 24*d*, and preliminary registration rollers 26. The recording material P held in the manual-feed tray 27 is separated one by one by a BC roller 29 and conveyed to the registration rollers 25 through the preliminary registration rollers 26. Further, a plurality of sheets of the recording material P held in the paper-feed deck 28 are fed to a paper-feed roller 61 through a pickup roller 60 and are separated one by one by the paper-feed roller 61 with reliability, thus being carried to the registration rollers 25.

An intermediary transfer unit (load apparatus) U will now be described.

The intermediary transfer unit U includes the intermediary transfer belt 30 as the intermediary transfer member. As a material for the intermediary transfer belt 30, for example, PET (polyethylene terephthalate), PVDF (polyvinylidene difluoride), or the like are used. The intermediary transfer belt 30 is extended around a drive roller 32, a tension roller 33 and a secondary transfer opposite roller 34.

The drive roller 32 is a roller for transmitting a driving force to the intermediary transfer belt 30 and rotationally drives the intermediary transfer belt 30 in a clockwise direction. The tension roller 33 is a roller for exerting an appropriate tension on the intermediary transfer belt 30 under the action of a pressing force of a spring (not shown). The secondary transfer opposite roller 34 and a secondary transfer roller 36 sandwich therebetween the intermediary transfer belt 30 so as to create a secondary transfer nip (secondary transfer station) therebetween.

The drive roller 32 is prepared by coating the surface of a metal roller with a several mm-thick layer of rubber (composed of urethane or chloroprene), thus preventing slipping with the intermediary transfer belt 30. The drive roller 32 is rotated by transmitting a rotating force thereto from the secondary transfer for rotationally driving the photosensitive drums 11*a* to 11*d* and is also provided with a coupling (not shown) as a transmission means. This coupling is also locked when the photosensitive drums 11*a* to 11*d* are rotated in the direction of the arrow inside drums 11*a* to 11*d* shown in FIG. 1 similarly as in the couplings 19 used for the photosensitive drums 11*a* to 11*d*, and is designed to release the lock by being rotated in a direction opposite to the direction of the arrow inside the drums 11*a* to 11*d* shown in FIG. 1.

On the backside of the intermediary transfer belt 30 at positions where the photosensitive drums 11*a* to 11*d* are disposed, primary transfer rollers 35*a*, 35*b*, 35*c* and 35*d*, to which a high voltage for transferring the toner image onto the intermediary transfer belt 30 is applied, are disposed, respectively.

A secondary transfer roller 36 is pressed against the intermediary transfer belt 30 under an appropriate pressure. Downstream from the secondary transfer roller 36 along the rotational direction of the intermediary transfer belt 30, a cleaning apparatus 50 for cleaning the surface (onto which the toner image is transferred) of the intermediary transfer belt 30 is disposed. The cleaning apparatus 50 includes a cleaner blade 51 (composed of, e.g., an urethane rubber) and a waste-toner box 52 for containing therein waste toner.

A fixing unit 40 includes a fixing roller 41*a* containing therein a heat source, such as a halogen heater or the like, a pressure roller 41*b*, which is pressed against the fixing roller 41*a* and optionally provided with a heat source, and an inner paper-output roller 44 for conveying the recording material P that has been discharged from these fixing and pressure rollers 41*a* and 41*b*.

On the other hand, the recording material P conveyed to the registration rollers 25 is once stopped by terminating the rotational drive of the upstream rollers, and then the upstream rollers and the registration rollers 25 are rotationally driven again at a timing of image formation at the image-forming station. The recording material P is sent to a stationary transfer nip, where the toner images on the intermediary transfer belt 30 are simultaneously transferred onto the recording material P.

The toner images on the recording material P after being subjected to the secondary transfer process are fixed by the fixing unit 40, and the recording material P is passed through the inner paper-output roller 44 and then its conveyance direction is switched by a switching flapper 73. In the case where the switching flapper 73 is located on a face-up output side, the recording material P is discharged in a face-up paper-output tray 2 by outer paper-output rollers 45. On the other hand, in the case where the recording material P is located on a face-down output side, the recording material P is conveyed in the direction of reverse rollers 72*a,* 72*b* and 72*c* and discharged in a face-down paper-output tray 3.

Incidentally, in the conveyance passage of the recording material P, a plurality of sensors for detecting passing of the recording material P are disposed. The sensors include paper-feed retry sensors 64*a,* 64*b,* 64*c* and 64*d;* a deck paper-feed sensor 65; a deck drawing sensor 66; a registration sensor 67; an inner paper-output sensor 68; a face-down paper-output sensor 69; a double-side preliminary registration sensor 70; a double-side paper re-feed sensor 71; and the like. Further, to the paper-feed cassettes 21*a* to 21*d* for accommodating the recording material P, cassette paper-presence/absence sensors 63*a,* 63*b,* 63*c* and 63*d* for detecting the presence or absence of the recording material P are disposed. To the manual-feed tray 27, a manually fed paper-presence/absence 74 for detecting the presence or absence of the recording material P on the manual-feed tray 27 is disposed. In the paper-feed deck 28, a deck paper-presence/absence sensor 75 for detecting the presence or absence of the recording material P in the deck 28 is disposed.

The control means includes a control board (not shown) for controlling operations of mechanisms in the respective units and a motor drive board (not shown) or the like. The stepping motor used in this embodiment is also controlled by this control means with respect to its rotational direction (normal/reverse) and rotational angle (revolution number). The control means further includes a timer.

An operation unit 704 is disposed on the upper surface of the image forming apparatus main assembly 1 and permits selection of the paper-feed stations (paper-feed cassettes 21*a* to 21*d,* manual-feed tray 27, and paper-feed deck 28), selection of paper-output trays (face-up tray 2 and face-down tray 3) and designation of a tab set.

Next, the operation of the image forming apparatus having the above-described structure will be explained. In the following, the case of feeding the recording material P from the paper-feed cassette 21*a* will be described as an example.

After the lapse of a predetermined time, timed by a timer, from transmission of an image-forming-operation start signal, the recording material P is sent one by one from the paper-feed cassette 21*a* by the pickup roller 22*a* and then is conveyed to the registration rollers 25 by the BC or paper-feed rollers 23*a* through the drawing rollers 24*a* and the preliminary registration rollers 26. At this time, the registration rollers 25 are stopped and a leading end of the recording material P reaches the nip between the registration rollers 25. Thereafter, the registration rollers 25 start rotation at a timing at the start of image formation at the image-forming station. The rotation timing is set so that the recording material P and the toner image, which has been primary-transferred onto the intermediary transfer belt 30 at the image-forming station, meet just at the secondary transfer nip.

On the other hand, at the image-forming station, when the image-forming start signal is sent, the toner image formed on the photosensitive drum 11*d,* which is located most upstream in the rotational direction of the intermediary transfer belt 30, is primary-transferred onto the intermediary transfer belt 30 at a primary transfer station by the transfer roller 35*d* supplied with a high voltage, through the above-mentioned process. The primary-transferred toner image is conveyed to a subsequent primary transfer station, at which image formation is performed, after the lapse of a time for conveying the toner image between first and second image-forming stations, so that a subsequent toner image is transferred and superposed on the conveyed toner image with its leading end in alignment with that of the conveyed toner image. A similar process is repeated for the remaining colors, so that four-color toner images are finally primary-transferred and superposed onto the intermediary transfer belt 30.

Thereafter, when the recording material P is fed to the secondary transfer nip to contact the intermediary transfer belt 30, a high voltage is applied to the secondary transfer roller 36 at a timing of passing of the recording material P, whereby the four-color toner images formed on the intermediary transfer belt 30 through the above-mentioned processes are transferred onto the recording material P at the same time. Thereafter, the recording material P is guided to a nip between the fixing roller 41*a* and the pressure roller 41*b* of the fixing unit 40. The toner image is heated and pressed by the fixing and pressure rollers 41*a* and 41*b,* thus being fixed on the surface of the recording material P. The recording material P on which the toner image is fixed is then discharged in the face-up tray 2 or the face-down tray 3, depending on the switching direction of the switching flapper 73.

Figure 6:
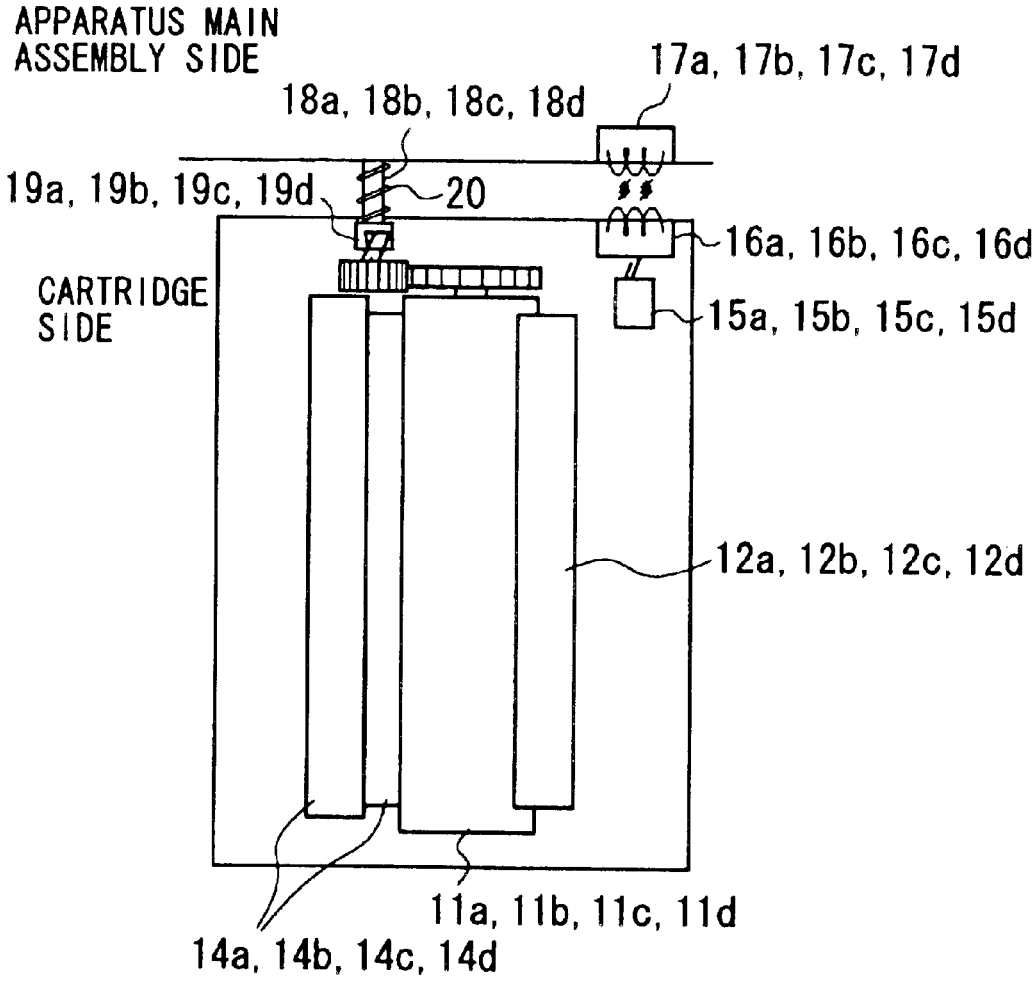
FIG. 6 is a schematic view of a general structure of the process cartridge.

FIG. 6 is a schematic structural view of the process cartridge (drum cartridge) to which the non-contact memory is mounted.

The drum cartridge is a unit, as a cartridge, including each of the photosensitive drums 11*a* to 11*d,* each of the charge rollers 12*a* to 12*d,* and each of the developing apparatuses 14*a* to 14*d,* at each of the image-forming stations.

The image forming apparatus main assembly 1 transmits power to the photosensitive drums 11*a* to 11*d* through driving shafts 18 (18*a* to 18*d*) and the couplings 19*a* to 19*d*. The image forming apparatus main assembly 1 also transmits power to the charge rollers 12*a* to 12*d* and the developing apparatuses 14*a* to 14*d* through other driving shafts and couplings (not shown).

Further, in the respective drum cartridges, nonvolatile memory circuits 15*a,* 15*b,* 15*c* and 15*d* and antennas 16*a,* 16*b,* 16*c* and 16*d* are mounted on the same side as the couplings 19*a,* 19*b,* 19*c,* and 19*d* to which the driving force is transmitted from the driving shafts. Also on the image-forming-apparatus-main-assembly side, antennas 17*a,* 17*b,* 17*c* and 17*d* are disposed opposite to the antennas 16*a,* 16*b,* 16*c* and 16*d,* respectively. In the case where a gap between each of the antennas 16*a* to 16*d* and each of the antennas 17*a* to 17*d* is sufficiently small, when an external magnetic field is formed by the antennas 17*a* to 17*d* on the image-forming-apparatus-main-assembly side, an induction current is generated in the antennas 16*a* to 16*d* on the drum-cartridge side by the magnetic field. The induction current not only supplies power to the nonvolatile memory circuits 15*a* to 15*d,* but also adds a signal component to the magnetic field, thus permitting reading out and writing of data stored in the memories of the nonvolatile memory circuits 15*a* to 15*d*.

Figure 7:
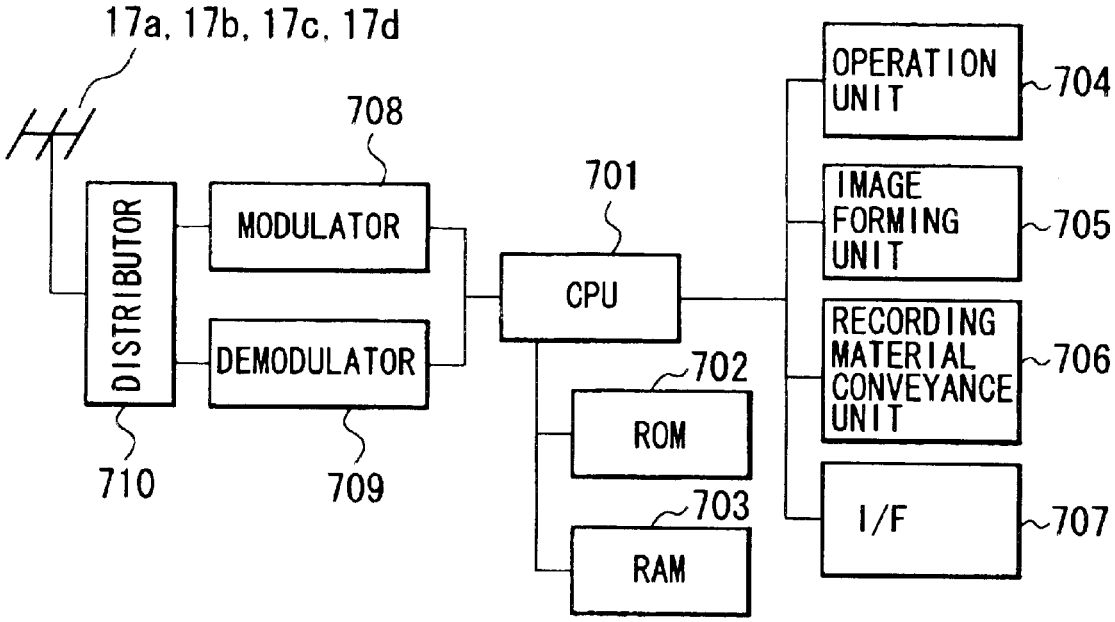
FIG. 7 is a schematic block diagram showing a general structure of the image forming apparatus.

FIG. 7 is a block diagram showing the general structure of the image forming apparatus main assembly 1.

Referring to FIG. 7, the image forming apparatus main assembly 1 includes a CPU (central processing unit) 701 for carrying out an essential control of the image forming apparatus main assembly 1. To the CPU 701, an ROM (read-only memory) 702 in which a control program is written and an RAM (random-access memory) 703 functioning as working storage for permitting the performing processing are connected through an address bus and a data bus. Also to the CPU 701, an operation unit 704 functioning as display means and key input means for the image forming apparatus main assembly 1, an image forming unit 705 for controlling the above-mentioned various processes regarding image formation, a recording-material conveyance unit 706 for controlling conveyance of the recording material P onto which an image is formed, and an I/F (interface) 707 functioning as a communication interface between the image forming apparatus main assembly 1 and external units, are connected. The CPU 701 reads out information for processing from the ROM 702 on the basis of the input information from the operation unit 704 or the I/F 707, and executes the image-forming operation on the recording material P successively.

Further, the image forming apparatus main assembly 1 includes, as a non-contact memory interface, a modulator 708, a demodulator 709, a distributor 710, and antennas 17*a*, 17*b*, 17*c* and 17*d*. The non-contact memory interface has such functions that a signal modulated by the modulator 708 on the basis of a control signal from the CPU 701 is sent from the antennas 17*a* to 17*d* to the drum-cartridge side through the distributor 710 and that a signal received by the antennas 17*a* to 17*d* is demodulated by the demodulator 709 through the distributor 710 and is sent to the CPU 701.

Figure 8:
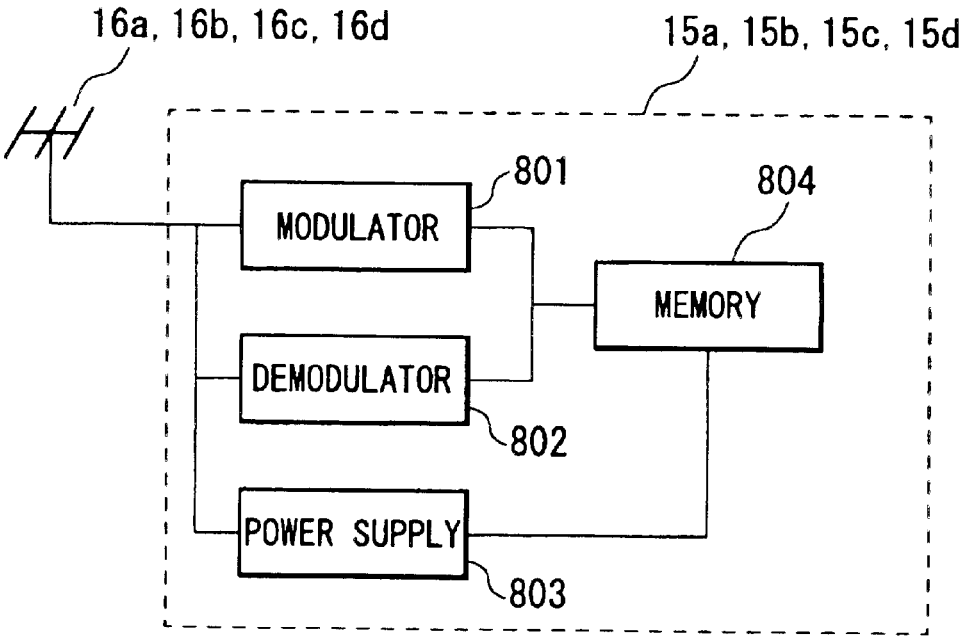
FIG. 8 is a schematic block diagram showing a general structure of a non-contact memory.

FIG. 8 is a block diagram showing the general structure of the non-contact memory including nonvolatile memory circuits 15*a* to 15*d* and antennas 16*a* to 16*d* on the drum-cartridge side.

In the non-contact memory, signals transmitted from the antennas 17*a* to 17*d* are received by the antennas 16*a* to 16*d*, respectively, and power required for actuating the nonvolatile memory circuits 15*a* to 15*d* is generated by a power supply 803. At the same time, the signal received by a demodulator 802 is demodulated, and reading out and writing of data stored in a memory 804 are performed. Data read out from the memory 804 is modulated by a modulator 801 and is sent to the image-forming-apparatus-main-assembly side.

Features of this embodiment, i.e., processing performed at the time when reading out of data stored in the non-contact memory mounted in the drum cartridge is effected in a closed state of a cover of the image forming apparatus main assembly 1 will be described.

The lives of the photosensitive drums 11*a* to 11*d*, the charge rollers 12*a* to 12*d*, and the developing apparatuses 14*a* to 14*d* assembled in the drum cartridges are sufficiently shorter than the operation life of the image forming apparatus main assembly 1, so that these members are designed to be simultaneously replaceable for each drum cartridge so as to facilitate a replacement operation of these members which have reached the ends of their lives. In such cases, it is desirable that the replacement of each of the drum cartridges can be performed at an appropriate timing by counting the number of operations for each drum cartridge so as to correctly determine the end of life of each drum cartridge and outputting a display calling the user's attention to the replacement of the drum cartridge which has reached the end of its life on the operation unit 704, as a warning message of the operation life of the drum cartridge at the time when the drum cartridge has reached the end of its life.

In determining the number of operations for the respective drum cartridges to ascertain the end of life of the drum cartridge, it is possible to use the number of sheets of recording material P subjected to image formation, an energization time, a cumulative image density, and the like Such values are required to be stored even when the image forming apparatus is not energized, and in view of the possibility that a drum cartridge is used in mid-life for another image forming apparatus due to the ease of handling the drum cartridge, various information on the number of operations are stored in the non-contact memory mounted in the drum cartridge. Further, by using the non-contact memory, the problem of contact reliability of the terminals that is caused due to the repetition of mounting/demounting operations of the drum cartridge is solved.

Figure 9:
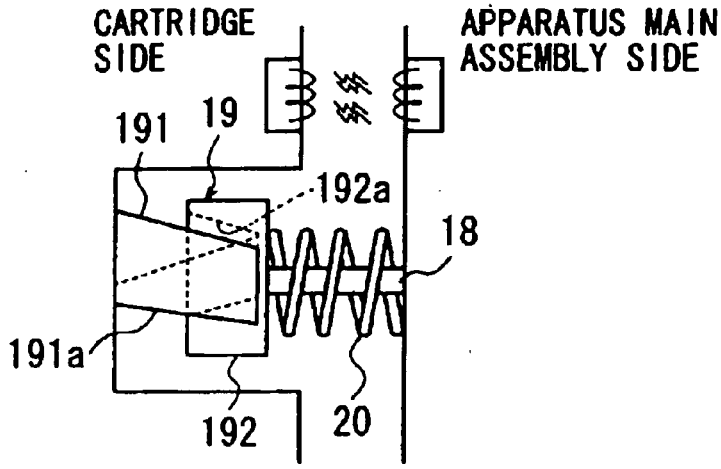
FIG. 9 is a schematic sectional view for illustrating the positional relationship between antennas of the non-contact memory and the image forming apparatus main assembly when the process cartridge is drawn in the apparatus.

In a state after the drum cartridges are mounted in the image forming apparatus main assembly 1 and the stepping motor is rotated, as described above, the drum cartridges have already been drawn by a drawing force of the driving shafts, whereby, as shown in FIG. 9, the triangular pole 191*a* of the coupling 191 on the drum-cartridge side enters the triangular hole 192*a* of the coupling 192 of the stepping-motor side as far as it will go. For this reason, the maximum spacing between the antennas 16*a* to 16*d* of the drum cartridges and the antennas 17*a* to 17*d* of the image forming apparatus main assembly 1 depends on distance the triangular pole 191*a* travels at the time when the triangular pole 191*a* enters the triangular hole 192*a* as far as it will go at the couplings (191, 192) and the position of the driving shaft 18 (18*a* to 18*d*) on the stepping-motor side at the time when the spring 20 expands to its full length. Accordingly, the communication ability of the antennas 16*a* to 16*d* and 17*a* to 17*d* may be designed so as to permit communication, with reliability at a minimum level, at such a distance between the antennas 16*a* to 16*d* and the antennas 17*a* to 17*d* in the above-mentioned state, and thus they are not required to communicate above this level.

Figure 10:
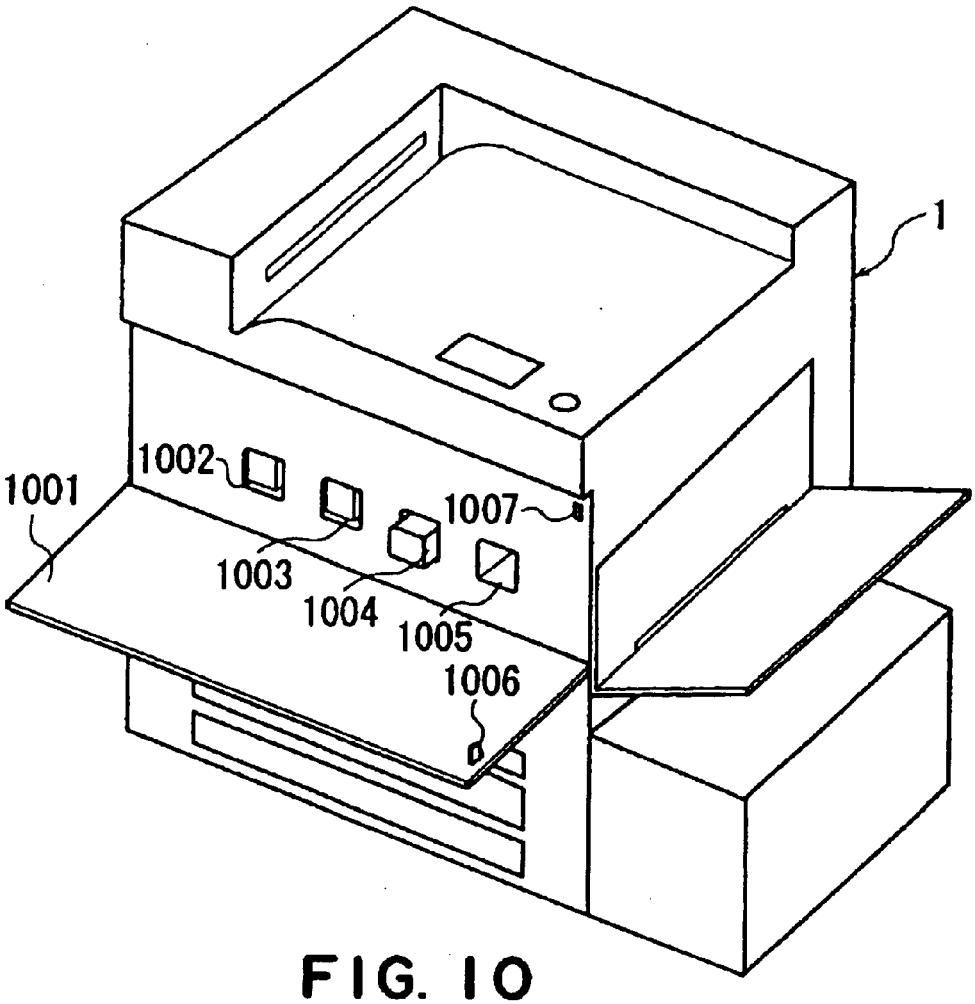
FIG. 10 is a schematic perspective view of the image forming apparatus.

Incidentally, the drum cartridges are designed to be mounted by inserting them from the front side to the back side on the drawing (FIG. 1). As is apparent from the perspective view of the image forming apparatus main assembly 1 shown in FIG. 10, it is necessary to open a front door 1001 of the image forming apparatus main assembly 1 in order that the drum cartridges are mounted in and dismounted from drum-cartridge mounting portions 1002 to 1005.

When the front door 1001 is closed, an open/close detection pin 1006 is inserted into a hole 1007 for the open/close detection pin 1006, and when the front door 1001 is opened, the open/close detection pin 1006 is disengaged from the hole 1007. Accordingly, a sensor (not shown) is provided at a deep position of the hole 1007 to detect the presence or absence of the open/close detection pin 1006, thus detecting the opening and closing of the front door 1001. More specifically, it is possible to detect not only the opening of the front door 1001 by an output of the front door open/close detection sensor at any time when the drum cartridge is replaced, but also the closing of the front door 1001 by an output of the sensor at any time when the front door 1001 is closed after the replacement of the drum cartridge(s) is completed, as long as the image forming apparatus is energized.

Accordingly, when the front door 1001 is shifted from the open state to the closed state by reference to the output of the front door open/close detection sensor, the image forming apparatus main assembly 1 rotates the stepping motor in the image-forming direction and then is slightly rotated reversely in order to transmit the driving force to the drum cartridges, thus drawing therein the drum cartridges through the couplings 191, 192. As a result, the image forming apparatus main assembly 1 is placed in a state that it is capable of communicating with the non-contact memories mounted in the drum cartridges with reliability. The reason why the stepping motor is slightly rotated reversely to release the connection at the couplings 191, 192 is because the drum cartridges can always be taken out when the front door 1001 is opened at the time other than image formation, even in a power-off state.

Further, this operation is always performed irrespective of the presence or absence of the drum cartridges. Thereafter, the image forming apparatus main assembly 1 reads out data of the memories stored in the non-contact memories by using the antennas 16*a* to 16*d* and 17*a* to 17*d* having the minimum communication ability as described above. If the data is correctly read out, on the basis of the data, the image forming apparatus main assembly 1 prepares for the image-forming operation. On the other hand, if the data is not correctly read out, on the basis of the resultant data, the image forming apparatus main assembly 1 performs such a treatment for the absence of the drum cartridge to be originally mounted as a result of a judgment that there is no photosensitive drum or an incorrect drum cartridge is mounted.

As described above, when the detection result of the cover (front door) required to be opened or closed for mounting the drum cartridge(s) is shifted from the open state to the closed state, the rotating shaft for transmitting the rotational driving force to the drum cartridge(s) is rotationally driven, whereby it becomes possible to immediately place the drum cartridges and the image forming apparatus main assembly 1 in a state that they are capable of communicating with each other with reliability by performing a minimum transmission and reception of electromagnetic waves therebetween.

Embodiment 2

An image forming apparatus of this embodiment performs the same operations as in that of Embodiment 1 except for an operation, after the image forming apparatus is turned on, which is specifically described below.

In a state that the power of the image forming apparatus is not turned on, it is impossible to judge that any specific drum cartridge is mounted in the image forming apparatus main assembly. Further, the front door open/close detection sensor is in an undetectable state, so that there is a possibility that the triangular pole and the triangular hole are appropriately engaged with each other at the (coupling) portion between the stepping motor and the photosensitive drum by performing mounting/dismounting of the drum cartridge during the power-off state.

As a result, assuming that the mounting state of the drum cartridge is unspecified at the time of turning the power on, it is possible to move an antenna for a non-contact memory mounted in the drum cartridge to a position which permits communication of the antenna with an antenna provided in the image forming apparatus main assembly when the drum cartridge is mounted by rotating the stepping motor and then slightly rotating it reversely. On the other hand, when the drum cartridge is not mounted, the stepping motor runs at idle as it is. Thereafter, the image forming apparatus reads out data by starting communication with the drum cartridge. If the data is readable, it is used for controlling the drum cartridge as it is. If the data is not readable, the operation for the absence of the appropriate drum cartridge is continued.

As described above, the rotating shaft exerting a rotational driving force on the drum cartridge is rotationally driven always when the power to the image forming apparatus is turned on, whereby it becomes possible to immediately place the drum cartridge and the image forming apparatus main assembly in a state that they are capable of communicating with each other with reliability by means of minimum levels of electromagnetic waves.

In the above-mentioned embodiment, the four-color-based full-color printer is used as the image forming apparatus of the present invention, but the present invention is also applicable to an image forming apparatus, such as a monochrome printer, a color or monochrome copying apparatus, a facsimile apparatus, or the like. The present invention is further applicable, in addition to the image forming apparatus, to an ordinary apparatus which transmits a rotational driving force to a load apparatus (unit) detachably mountable to an apparatus main assembly and provided with a non-contact memory.

INDUSTRIAL APPLICABILITY

As described hereinabove, according to the present invention, there is provided an image forming apparatus including a process cartridge which is detachably mountable to an apparatus main assembly and includes a non-contact memory, antennas for performing communication of data stored in the non-contact memory with the apparatus main assembly, and a rotating shaft (axis) for receiving a rotational driving force from the apparatus main assembly which includes antennas for performing communication of data stored in the non-contact memory with the antennas of the process cartridge and a connection (coupling) portion for exerting the rotational driving force on the process cartridge. In the image forming apparatus, the apparatus main assembly rotationally drives the connection portion before reading out of the data stored in the non-contact memory, which is mounted in the process cartridge, so that it becomes possible to effectively read out the data immediately and with reliability without outputting more electromagnetic waves than necessary, to the non-contact memory mounted in the process cartridge, which is detachably mountable to the apparatus main assembly.

While the invention has been described with reference to the embodiments and structures disclosed herein, it is not confined to the details set forth and this application is intended to cover such modifications or changes as may come within the purpose of the improvements or the scope of the following claims.

What is claimed is:

1. An image forming apparatus, comprising:

an apparatus main assembly; and a process cartridge detachably mountable to said apparatus main assembly, said process cartridge including:

a driving force receiver configured and positioned to be connected to a driver of said apparatus main assembly; and a non-contact memory configured and positioned to perform non-contact data communication with a data receiver of said apparatus main assembly, wherein said apparatus main assembly performs rotational driving of the driver of said apparatus main assembly before reading out data from said non-contact memory.

2. An apparatus according to claim 1, wherein said driving force receiver and said non-contact memory are disposed on the same side of said process cartridge.

3. An apparatus according to claim 1, wherein there is a gap between the data receiver of said apparatus main assembly and said non-contact memory, and wherein the rotational driving of the driver of said apparatus main assembly exerts a force on said process cartridge in a direction to narrow the gap between the data receiver and said non-contact memory.

4. An apparatus according to claim 1, wherein said apparatus main assembly includes:

an open/closed member configured and positioned to be opened and closed at the time of mounting and dismounting of said process cartridge; and an open/closed detector configured and positioned to detect an open/closed state of said open/closed member, and wherein said apparatus main assembly performs rotational driving of the driver of said apparatus main assembly, when said open/closed detector detects that said open/closed member is shifted from an open state to a closed state.

5. An apparatus according to claim 1, wherein said process cartridge further includes a photosensitive member, which is rotated by a driving force received by the driving force receiver.

* * * * *

UNITED STATES PATENT AND TRADEMARK OFFICE

CERTIFICATE OF CORRECTION

PATENT NO. : 6,892,033 B2
APPLICATION NO. : 10/689653
DATED : May 10, 2005
INVENTOR(S) : Hidenori Sunada et al.

It is certified that error appears in the above-identified patent and that said Letters Patent is hereby corrected as shown below:

COLUMN 2
Line 45, “powder” should read --power--.
Line 60, “assembly,” should read --assembly;--.

COLUMN 3
Line 35, “DESCRIPTION” should read --DETAILED DESCRIPTION--.

COLUMN 5
Line 9, “in” should be deleted.

COLUMN 6
Line 46, “an” should read --a--.
Line 56, “once stopped” should read --stopped once--.

COLUMN 7
Line 53, “has” should read --have--.

COLUMN 9
Line 59, “like” should read --like.--.

COLUMN 10
Line 13, “distance” should read --the distance that--.
Line 29, “that” should read --for--; and “are” should read --to be--.

Signed and Sealed this

First Day of August, 2006

JON W. DUDAS
*Director of the United States Patent and Trademark Office*